US009169574B2

(12) United States Patent
Vidaurre Heiremans et al.

(10) Patent No.: US 9,169,574 B2
(45) Date of Patent: Oct. 27, 2015

(54) INSTALLATION AND INDUSTRIAL OPERATION OF AN AIR SUPPLY SYSTEM TO DOSE GIVEN AIR FLOWS TO EACH INDIVIDUAL CELL OF A SET OF ELECTROLYTIC CELLS

(75) Inventors: Víctor Vidaurre Heiremans, Santiago (CL); Edgardo Beltran Navarro, Santiago (CL); Victor Manuel Vidaurre Miller, Santiago (CL)

(73) Assignee: ANCOR TECMIN, S.A., Santiago (CL)

( * ) Notice: Subject to any disclaimer, the term of this patent is extended or adjusted under 35 U.S.C. 154(b) by 544 days.

(21) Appl. No.: 13/515,501

(22) PCT Filed: Mar. 17, 2010

(86) PCT No.: PCT/EP2010/053490
§ 371 (c)(1),
(2), (4) Date: Aug. 24, 2012

(87) PCT Pub. No.: WO2011/085824
PCT Pub. Date: Jul. 21, 2011

(65) Prior Publication Data

US 2013/0220831 A1 Aug. 29, 2013

(30) Foreign Application Priority Data

Jan. 13, 2010 (CL) ..... 023-2010

(51) Int. Cl.

| | |
|---|---|
| ***C25C 7/06*** | (2006.01) |
| ***B01F 3/04*** | (2006.01) |
| ***C25C 1/12*** | (2006.01) |
| ***C25C 7/00*** | (2006.01) |
| ***C25D 5/08*** | (2006.01) |
| ***C25D 21/10*** | (2006.01) |

(52) U.S. Cl.
CPC ..... *C25C 7/06* (2013.01); *B01F 3/04269* (2013.01); *C25C 1/12* (2013.01); *C25C 7/00* (2013.01); *C25D 5/08* (2013.01); *C25D 21/10* (2013.01); *B01F 2003/04319* (2013.01); *B01F 2003/04361* (2013.01)

(58) Field of Classification Search
USPC ..... 205/376, 367; 204/246, 270, 277
See application file for complete search history.

(56) References Cited

U.S. PATENT DOCUMENTS

| | | | | |
|---|---|---|---|---|
| 3,420,111 | A * | 1/1969 | Evans | 74/5.7 |
| 2007/0251828 | A1 * | 11/2007 | Grazier et al. | 205/291 |

* cited by examiner

*Primary Examiner* — Arun S Phasge
(74) *Attorney, Agent, or Firm* — Karim Lagobi

(57) ABSTRACT

The invention refers to an air supply system (1) for a group of cells (4) arranged for dosing the individual air demand of each electrolytic cell (2) that must be fed to its electrolyte through a system of controlled air diffusion. It comprises a low pressure blower (5), a central feed pipe (6) and a plurality of feed branches (7); a flow meter (8) and a flow regulator (9) are associated to each feed branch. The assembly is connected to a bent hose (12) arranged on the walls of said electrolytic cell (2) to allow connection with an isobaric ring (3), so that the fed air can be diffused homogeneously and sustainedly in time to the electrolyte through selectively perforated hoses (16). The present invention also refers to the process of installation, calibration and operation of the air supply system.

13 Claims, 9 Drawing Sheets

INSTALLATION AND INDUSTRIAL OPERATION OF AN AIR SUPPLY SYSTEM TO DOSE GIVEN AIR FLOWS TO EACH INDIVIDUAL CELL OF A SET OF ELECTROLYTIC CELLS

TECHNICAL FIELD OF THE INVENTION

The present invention refers to a system of individual air supply to each cell of a group of electrolytic cells, which assures that each cell receives constantly in time its established individual air demand necessary to achieve stably the electrodeposition results desired, comprised by a low pressure air blower—generally in a remote location relative to the cell—which generates a flow of air sufficient to supply the total air demand of a plurality of cells installed in a plant. The flow of air—of at least one blower—is transported by a feed pipe from which a plurality of feed hoses branch off in front of each of the external front walls of the plurality of cells. Each cell receives its feed hose from the feed pipe line from the blower, whose terminal connects to the lower entrance of a flow meter disposed vertically on the front wall of each cell, whose upper exit is connected to the second hose disposed so that it surrounds the upper edge of the front wall of the cell, and connecting with a perimetral isobaric ring with diffusers for the sustained homogeneous air supply under the electrodes of each cell. To insure that each cell can adequately receive its predetermined air demand in a homogeneous and sustained manner in time from the central air feed pipe, the feed hose entering the lower entrance of the flow meter is equipped with an adjustable squeeze clamp or flow regulator valve, which allows regulation and calibration of the amount of air admitted from the central feed pipe to each cell, and which is measured and monitored by the flow meter according to the pre established air demand needed in each cell. The flow meter is designed so that in the event that the hydraulic back pressure from the column of electrolyte becomes greater than that of the air fed through the diffusers, said flow meter has means of hydraulic retention that prevent the electrolyte from entering trough the flow meter to the central air feed pipe. This system solves the problem of dosing stable, given pre determined air flows to each individual cell of a plurality on going in time, from a common remote air source in a bay of cells—in an electrowinning plant—which generally are located close to mines normally in areas of high altitude—or in an electrorefining plant, where the correct functioning of each electrolytic cell requires that different specific air demands be supplied in time.

BACKGROUND OF THE INVENTION

The concept of enhancing electrolyte convection in an electrowinning or electrorefining cell to generally improve the results of metallic electrodeposition by means of controlled gas diffusion from a horizontal plane near the bottom and under the electrodes of the cell has been know for many years. Both the quality of the metal electrodeposited in the harvested cathode as well as the productivity of each cell—by effect of higher current density applicable to the process without quality compromises—are considerably increased applying especially soft aeration to the process in each cell.

In the prior art, there are several designs of apparatus that allow diffusing low pressure gas bubbles inside an electrolytic cell. One of them is by means of an isobaric ring fitting the internal normally rectangular perimeter of the cell generally improves the results of metallic electrodeposition, These rings are formed by straight tubes of circular cross section connected in rectangular manner, to conduct the dosed gas at low pressure throughout its interior, generating bubbles upon emerging uniformly from the lower horizontal plane under the electrodes of the cell and rising to the surface of the electrolyte. For that purpose, the opposite sides of said rectangular ring are connected transversally from side to side with perforated tubes, microporous or microperforated hoses, from Which gas bubbles emerge at low pressure through the perforations of the tubes or hoses, With given initial diameters—that increase as the bubbles ascend to the electrolyte surface—because of the gradually diminishing pressure of the electrolyte column over the bubbles as they rise.

There are several patent documents that disclose solutions to the provision of bubbles of saturated gas or air to the electrolyte of an electrowinning or electrorefining cell.

Document U.S. Pat. No. 1,260,830, published Mar. 26, 1918, titled "Electrolytic deposition of copper from acid solutions" discloses copper electrodeposition by means of continuous agitation of the electrolyte, particularly sweeping the surface of the vertical anodes with a mixture of sulfur dioxide gas and vapor, projected from orifices perforated in transversal lead pipes, disposed parallel to and under the anodes in the cell, with the orifices oriented in such a manner that the fluid emerges in an oblique angle striking the surface of the anodes, forcing continually the electrolyte circulation with maximum agitation and turbulence occurring by impact of the mixture directly on the faces of the anodes.

Document U.S. Pat. No. 3,928,152, published Dec. 23, 1975, titled "Method for the electrolytic recovery of metal employing improved electrolyte convection", describes a method of high quality copper electrodeposition on permanent cathodes plates at very high current densities. To achieve high productivity the separation between electrodes is reduced to a minimum with separators—distancers that position them exactly relative to each other, and simultaneously, provide very aggressive continuous agitation of the electrolyte by gas sparging tubes placed under each cathode, disposed to sweep the faces of the cathodes with curtains of bubbles that emerge from holes perforated in the tubes.

Document U.S. Pat. No. 3,959,112 published May 25, 1976, under the title "Device for providing uniform air distribution in air-agitated electrowinning cells", discloses air bubbling devices placed transversely to the cell length parallel on both faces of the cathodes just below their lower edge. The device comprises rigid perforated tubes that allow discharging air in bubbles of relatively large diameter with minimum pressure loss, whereby said tubes are enclosed externally with sleeves of larger diameter permeable material that oppose resistance and restrict the passage of the air bubbles, forcing them to emerge continuously from the sleeves as curtains of very fine bubbles that then sweep vertically both faces of the cathode and thus inhibiting the formation of rugosities on the metal deposit.

U.S. Pat. No. 4,263,120, published Apr. 21, 1981, under the title "Electrolytic cell for the recovery of non ferrous metals and an improved anode therefor", discloses the operation of the process with electrolyte agitation by means of perforated gas bubbler tubes placed parallel under the anodes to create ascending electrolyte turbulence in the interfaces of the electrodes.

Document CL 527-01, published Sep. 27, 2002, today patent CL 44.803 titled "System and method to capture and extract acid mist from polymer concrete containers, were the side, frontal and back walls are modified to allow horizontal seat of a thermal cover that forms a chamber connected to extraction ducts, method of fabrication and container for such purpose", discloses an electrolytic cell that comprises among other elements, a duct for injection of fresh air with gas diffusers installed parallel, and in a plane in the inferior portion of the cell, that directs the air bubbles under the electrodes.

Document CL 2140-2004, published Jul. 27, 2006, (equivalent to document WO 2005/019502) titled "Method to operate and electrolytic cell . . . " discloses gas diffusers for the transfer by gas bubbling to liquid means comprising an element consisting of a body of cylindrical connection that is prolonged in a tube conical zone ending in a closed end; between the cylindrical zone and the end zone there is a multi perforated separation wall trough which from the interior of the cylindrical body air circulates at constant pressure and velocity, generating a gas stream that distributes forming gas minijets.

Document CL 727-2006 published Jul. 7, 2006, titled "Electrolyte agitating device that consists of a reticulated structure, flat and of regular plant, formed of non electric conducting polymer composite materials resistant to corrosion, and, comprising an isobaric gas distribution ring, gas diffuser means; and electrolyte agitation system", discloses an electrolyte agitation apparatus immersed in containers for electrolytic cell used in the processes of electrowinning and electrorefining of non ferrous metal, formed by pipes of anticorrosive and non conducting materials, joined by connecting elements, were said joined pipes are crossed over from one side to the other by gas diffuser means, were said joined pipes and connected elements form and isobaric ring, which is encapsulated in the interior of a shape formed monolithically of anticorrosive dielectric polymer composite material, forming one flat, perimetral parallelepiped structure, homologous to the shape of the bottom of the container, where said perimetral structure is reticulated to impart rigidity and necessary structural resistance to be self supporting.

Document CL 0025-2008 published Mar. 18, 2008, discloses an aeration system by microbubbles for the electrowinning of copper at high current density, comprising independent pipes for the electrolyte, and connected together by spray nozzles for jetting the mixture of electrolyte-air to the interior of the cell and a line of aspiration and a pulse generator.

Document CL 00642-2007, published Oct. 26, 2007, describes equipment for the circulation of electrolyte and gases in an electrolytic cell, comprises perforated tubing for the circulation of electrolyte and one or more circuit of perforated tubing for gas injection affixed to a supporting structure with a plurality of guides for anodes and cathodes allowing the introduction and retrieval from the cell.

In general, in all prior art described, notwithstanding advantages disclosed in the results of electrodeposition with air bubbles sparged in the electrolyte, all solutions disclosed are oriented to describing the supply of aereation inside a single cell. None of the documents cited approaches the problem involved in generating air centrally and distributing air dosed exactly to each individual cell in a group of cells, in a bay of cells or in general, in an electrowinning or electrorefining plant, where each electrolytic cell demands an individual predetermined air flow.

In industrial electrowinning or electrorefining plants, the aereation equipment used in the cells can—abruptly or progressively—change its pneumatic characteristics within its service life, thereby requiring systematic individual adjustment or replacement whenever the original characteristics are lost or as they get damaged by other causes. It is well known in the art that successful operation of the cells require harmonization of several operational parameters until the desired electrodeposition results are obtained; and once established, such harmony must be duly adjusted and controlled in time following an operational management protocol of principal variables such as: cell voltage, current density, electrolyte temperature, copper tenor, pH and flow, among others. It is these parameters that determine the quality of copper deposit obtained on the cathodes at harvest time. With the introduction of gentle aereation in the cells an additional parameter is added to the operational management protocol that also needs the same harmonization, control and adjustment together with the others just mentioned, such as the homogeneous and controlled gas diffusion, preferably air, from a horizontal plane near the bottom of the cell under the electrodes, enhancing convection that favors the results of metallic electrodeposition. In practice, all these parameters are adjusted according to the electrodeposition results actually obtained on the cathodes. In as much as the overall cathode metal quality improves, the parameters are maintained stable during the operation of the cell, and are only adjusted to overcome unfavorable trends in the quality of harvested cathodes. The variability depends not only on the parameters of the generic electrodeposition process but also on the condition of wear and tear, useful life and replacement of the cell proper and its associated equipment. This explains the difficulty and complexity in correctly harmonizing these parameters well for each cell within a plant, specially maintaining them steady and uniform in each cell, and therefore, it is absolutely necessary to provide means, systems and methods for constantly monitoring them in real time. Accordingly by the facts presented, the volume of air that each individual cell demands is variable in time according to the pneumatic characteristics of its diffusion mean, and therefore, it becomes necessary to determine for each cell, the optimal flow that each must receive so as to obtain uniform and sustained electrodeposition results from all the cells in a plant.

SUMMARY OF THE INVENTION

To resolve the problems described above, the present invention refers to an air supply system for a group of cells, assuring a specified air demand stably in time in each cell. Said system is formed by at least one low pressure blower that generates a global flow of air, equivalent to the sum of the individual pre determined air demand of each individual cell distributed in a plant, that is conducted by at least one feed pipe, from which a plurality of feed hoses emerge in front of each front wall of each cell of a plurality of cells. Each cell receives a first hose from the central feed pipe whose end finishes in the lower end of a vertically disposed flow meter affixed to the cell front wall. From the upper end of the flow meter emerges a second feed hose passing over the upper edge of the cell, bending downwards on the interior of the front wall until connecting conveniently with a controlled diffusion system, for example, a system with an isobaric ring for the distribution of the air admitted from the feed pipe network to the cell, with its diffusers that eventually deliver the air homogeneously distributed throughout the electrolyte. The dosed air amount fed emerges uniformly and stably diffused through selectively perforated hoses chosen for that purpose in given patterns of appropriate bubbles to enhance the productivity and quality of electrodeposition desired.

To ensure that each cell receives, sustained in time, the adequate air demand for the correct functioning of its diffusers, in the portion of the feed hose before the entrance to the flow meter, an adjustable squeeze clamp or regulator valve is provided, which allows regulating, calibrating and monitoring the stability of the set calibration of the established air demand, the flow being measured by means of a vertically floating ball in the actual air stream according to the air demand inside the cell. The flow meter is equipped with maximum and minimum sensors of the vertical ball displacements, Which emit a signal to a remote central control unit, allowing timely corrective actions to be taken in the event of malfunctions in the individual air supply in any cell. The flow meter is also designed and equipped so that in the event the backpressure generated by the hydraulic column of the electrolyte exceeds that of the incoming air pressure through the diffusers, the flow meter has fluid retention means that prevent the electrolyte from entering the central feed pipe network through the flow meter.

BRIEF DESCRIPTION OF THE DRAWINGS

The enclosed drawings are included to provide a better understanding of the invention, become incorporated and constitute part of the following description, illustrate prior art and one of the preferred embodiments of the invention, and together with the detailed description, also serve to explain the principles of this invention, but are not limiting

DETAILED DESCRIPTION OF EMBODIMENTS OF THE INVENTION

Figure 1:
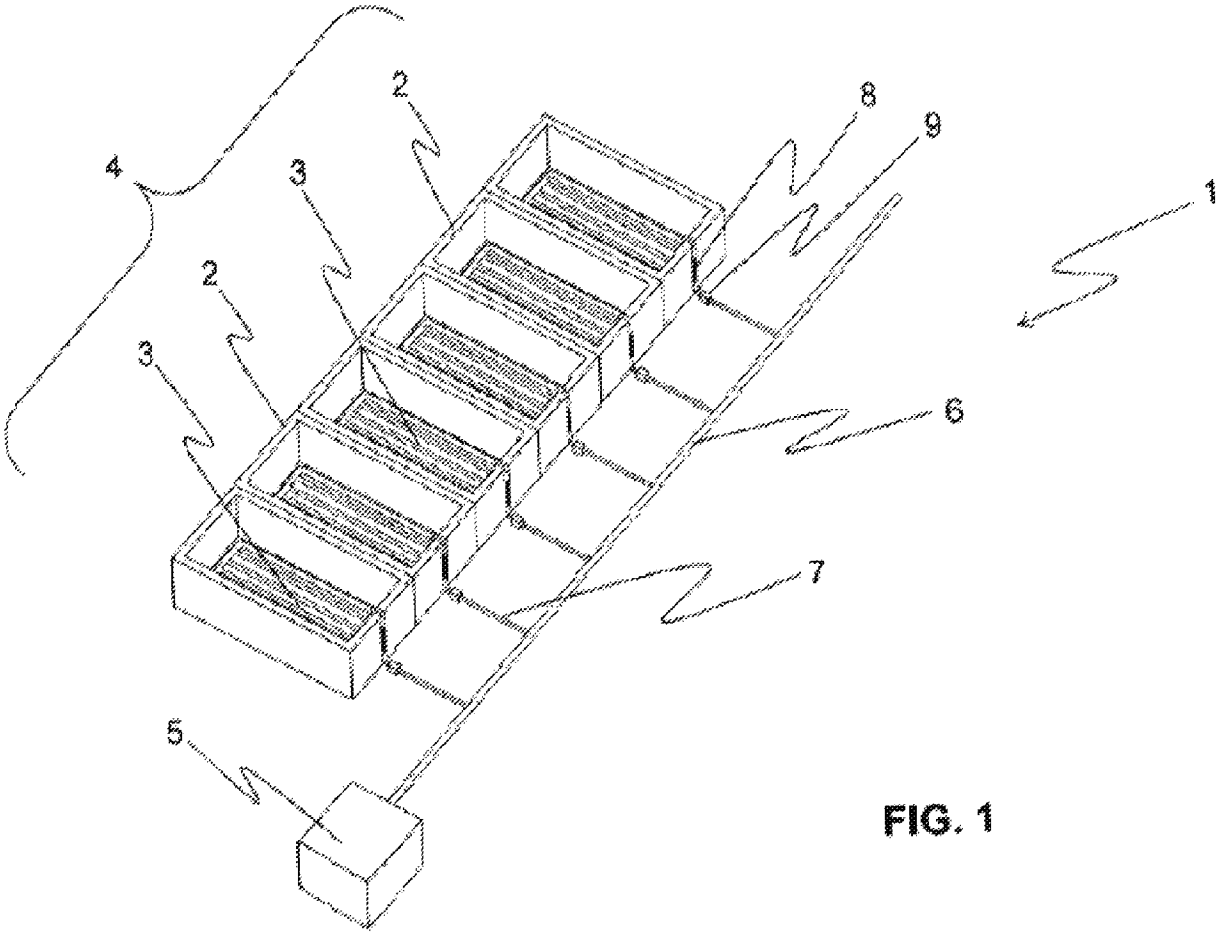
FIG. 1 shows an isometric view of one embodiment of the air supply system for a group of cells.
Figure 2:
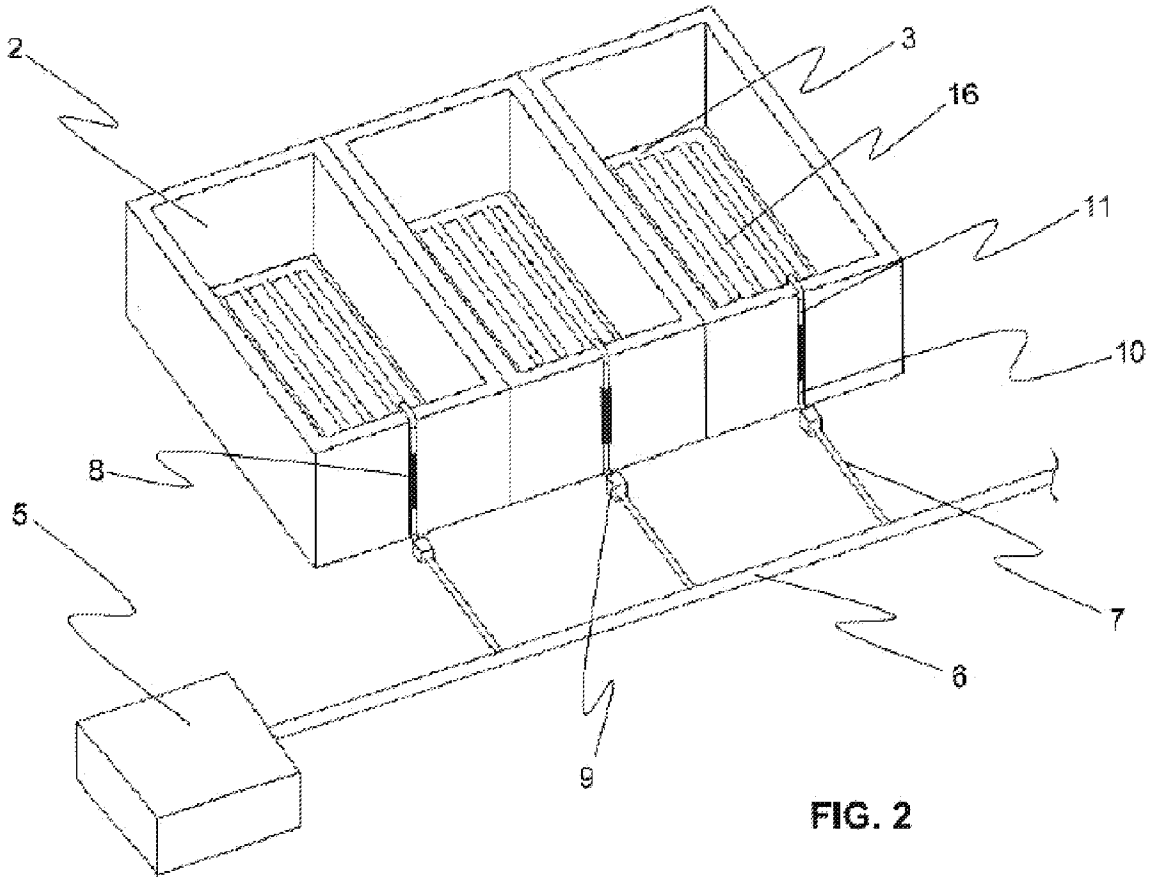
FIG. 2 shows an enlarged isometric view of the air supply system for a group of cells shown in FIG. 1.
Figure 3:
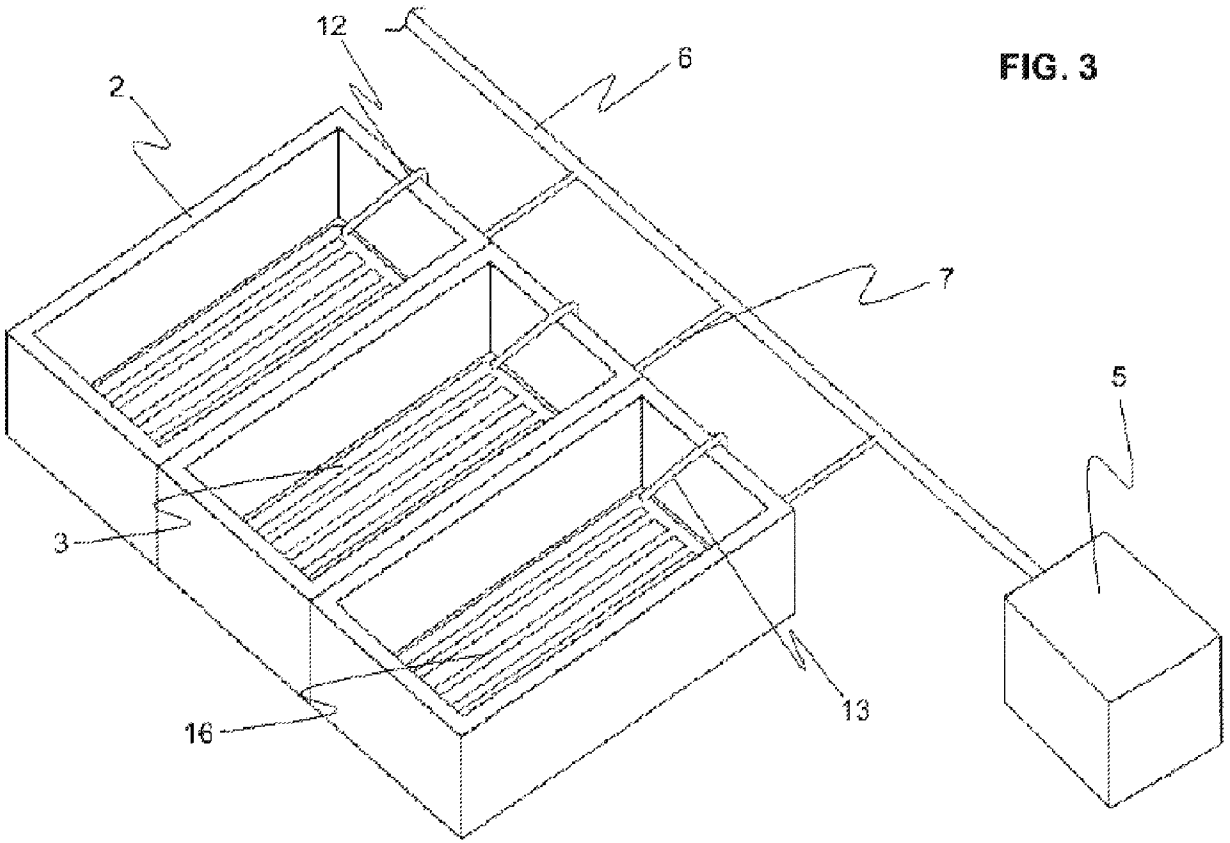
FIG. 3 shows an enlarged isometric view of the interior of the cells with the air supply system for a group of cells shown in FIG. 1.

Embodiments of the present invention refer to an air supply system (1) for a group of cells (4) that assures the individual air demand required by each cell (2) in an operator friendly manner for industrial cell operation, that must be diffused in the electrolyte through an air diffusion system in a controlled, uniform manner sustained in time for correct functioning, so as to achieve uniformly and stably in time the desired electrodeposition results, for example, using selectively perforated diffuser hoses (16) with given diameters, alignments and patterns to continuously supply a predetermined volume of air with a given pressure drop, installed in a controlled air diffusion system, for example an isobaric ring (3).

In order for the air supply system (1) to supply such given air demand, in a controlled, uniform and sustained manner in time to each individual cell (2), it is made up of at least one low pressure air blower (5) where the air is conducted by at least one central feed pipe (6), from which a plurality of feed hoses (7) branch off and reach the front wall of each electrolytic cell (2).

Figure 6:
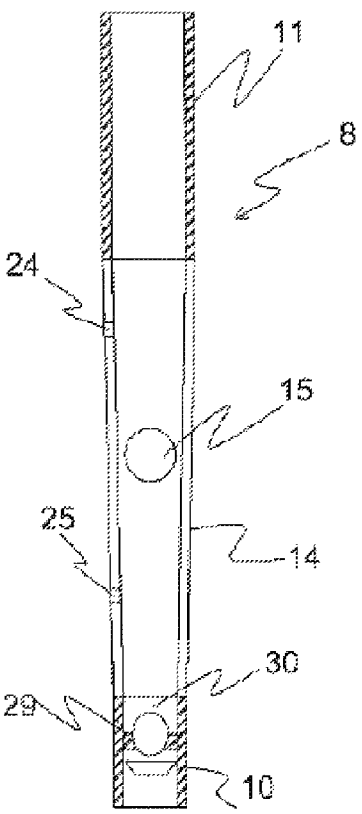
FIG. 6 shows another cross section view of a second embodiment of the flow meter used in the air supply system for a group of cells of the present invention.
Figure 5:
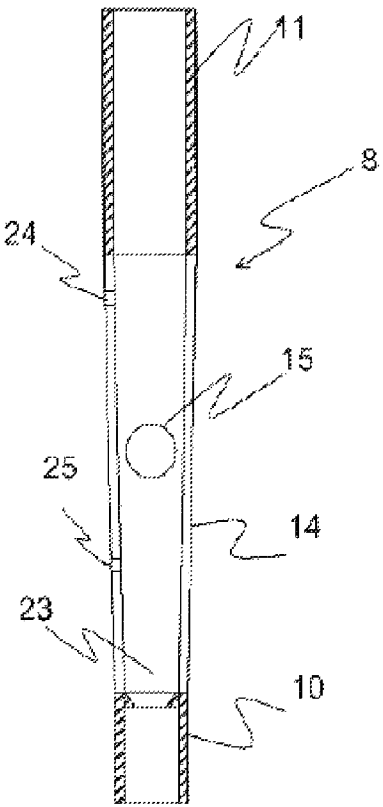
FIG. 5 shows a cross section view of the flow meter used in the air supply system for a group of cells of the present invention.
Figure 4:
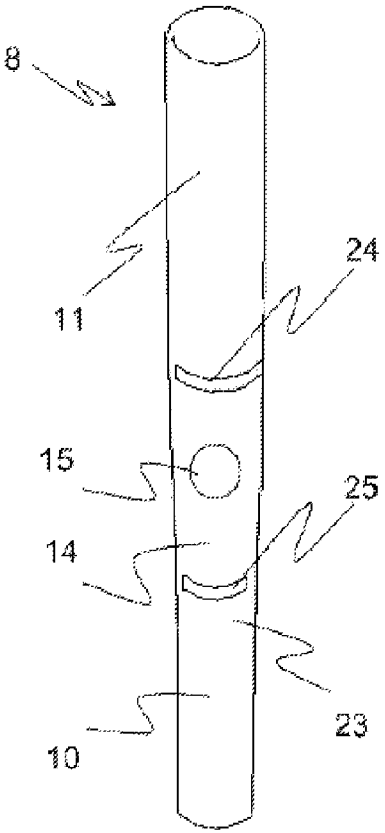
FIG. 4 shows an isometric view of the flow meter used in the air supply system for a group of cells of the present invention.

Said each branch feed hose connects with a flow meter (8), whose air control is regulated by a flow regulator (9), that can be an adjustable squeeze clamp on hose (7), or else a proper regulator valve. Flow meter (8) is connected between a first feed hose (10) and a second feed hose (11), where the first feed hose (10) comes from the flow regulator (9) and the second feed hose (11) connects with a portion of bent hose (12) adequately arranged on the front wall of the cell (2) to allow connection of a terminal (13) of the feed hose with the isobaric ring (3) for the air to be diffused into the electrolyte by the selectively perforated hoses (16) that form part of the supply system (1) of the present invention. Flow meter (8) that likewise forms part of the air supply system (1) of embodiments of the present invention, is made up preferably of a translucid tube (14) lodging inside it a sphere (15) which floats vertically according to the volume of air actually flowing to the cell. Said translucid tube has an inverted conical shape so that its lower portion diameter is smaller than that of the floating sphere (15) for the purpose that it serves also as an emergency check or retention valve, in the event that the electrolyte hydrostatic column pressure inside the cell (2) becomes larger than the diffused air pressure, forcing the sphere (15) down against the decreasing tube diameter, interrupting the passage of electrolyte towards the central feed pipe (6), shutting off the electrolyte when the sphere (15) positions itself on seat (23). The flow meter (8) is supplied with both an upper (24) maximum and lower (25) minimum limits for sphere (15) displacement, which can be coupled to electronic sensors (26) that transmit proximity signals through a communication media (27), that can be hard wired or wireless, to a means of remote monitoring of the individual cell operation, to signal the proximity to either limit positions of the sphere (15), setting off alarms in the monitoring means (28) in the events that sphere (15) is at or goes past the maximum limit (24) or minimum limit (25); so that it will allow an operator to react and take appropriate corrective actions to resolve the anomalous behavior of the air supply system in any cell (2) of the group of cells (4). If the flow of air supply is too low or too high, sphere (15) could result too light or too heavy and inappropriate to effectively shut off the electrolyte flow upon resting on seat (23). For that reason, in a second embodiment according to FIG. 6, flow meter (8) can be supplied with a second more appropriate sphere (30) and an occlusion seat (29) that allows blocking electrolyte passage if its back pressure is greater than the feed air pressure. A person skilled in the art will be able to use other equivalent means, for example, a unidirectional valve to more positively block entrance of electrolyte to the air supply system feed pipe whenever the hydrostatic column pressure in any cell becomes larger than the working pressure of the air supply system.

One of the problems that the prior art has confronted, and which has prevented sustained supply in time of correctly dosed individual air demand to each cell (2) of a group of cells (4) is the practical fact that microporous hoses are frequently used as air diffusers, for example made of recycled rubber, which are hoses used in water applications for underground irrigation of agricultural soils, application for which no precise hydraulic characterization is necessary. This type of hose has a random porosity distribution generated by its manufacturing process by agglomeration of rubber granules, and in fact, for use with air, these hoses do not have a stable pneumatic characterization per meter of length (volume of air flow with a given pressure drop), and therefore, are not really appropriate for use as stable air diffusers. Besides, the characteristic random variability exhibited by said microporous hoses when used with air, even when new at the start of their service life, whatever characteristic they may have initially cannot be sustained stably in time due to frequent and random obstructions with particulate material present in the electrolytes in which they are immersed, that can penetrate the hoses through larger pores, when, for any reason, the air supply is cut off towards cell (2); and upon reestablishment of the air supply, the foreign particles inside generally do not find pores of sufficient diameter to escape clean from the hoses, and actually obstruct air passage when they get stuck in the pores. The massive use of these hoses as air diffusers creates the problem, on one hand, that each cell (2) must diffuse its volume of air homogeneously throughout its electrolyte—and maintain that given flow constant in time—in order to accrue the electrodeposition benefits provided by soft aereation in the conditions described, and on the other hand, taking into consideration the conditions of raw materials and manufacture of said microporous hose, the random and irregular microporosity, the density and diffusion uniformity of bubbles in the electrolyte can be totally different between any two cells, thus requiring a system that allows dosing individual flows, stably in time, and appropriate for the means of air diffusion available from a common source of external air.

Per the above discussion, in order to stably dose a given air flow inside each electrolytic cell (2), alternatively, this system contemplates additionally that the diffusers in the isobaric rings to which the external air is fed be equipped with selectively perforated hoses that enable assuring that the pneumatic characteristics of each isobaric ring will be maintained stably so that the air feed flow can be precisely adjusted from the central feed pipe for the exact air demand of each cell for correct aeration.

Figure 8:
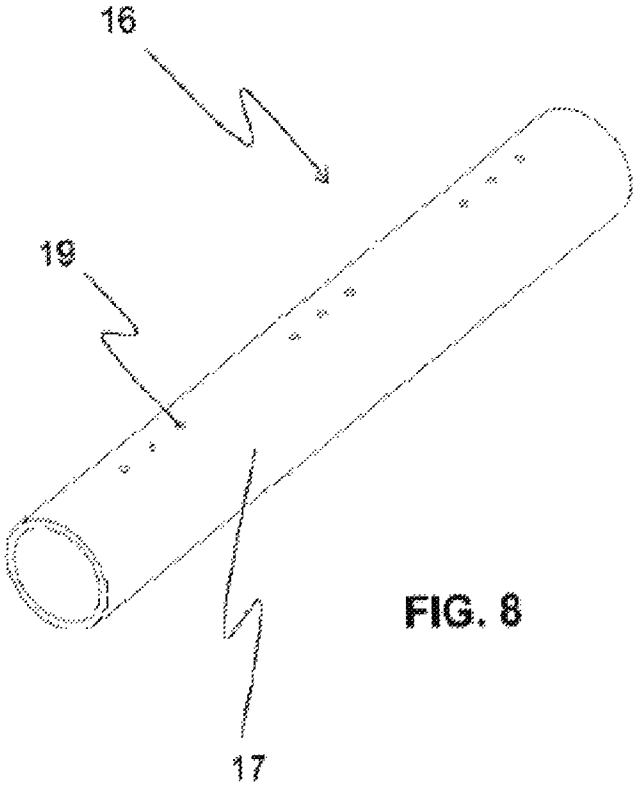
FIG. 8 shows an isometric view of a second embodiment of a selectively perforated hose used in the air supply system for a group of cells of the present invention, with a pattern of non continuous perforations aligned at 0°.
Figure 7:
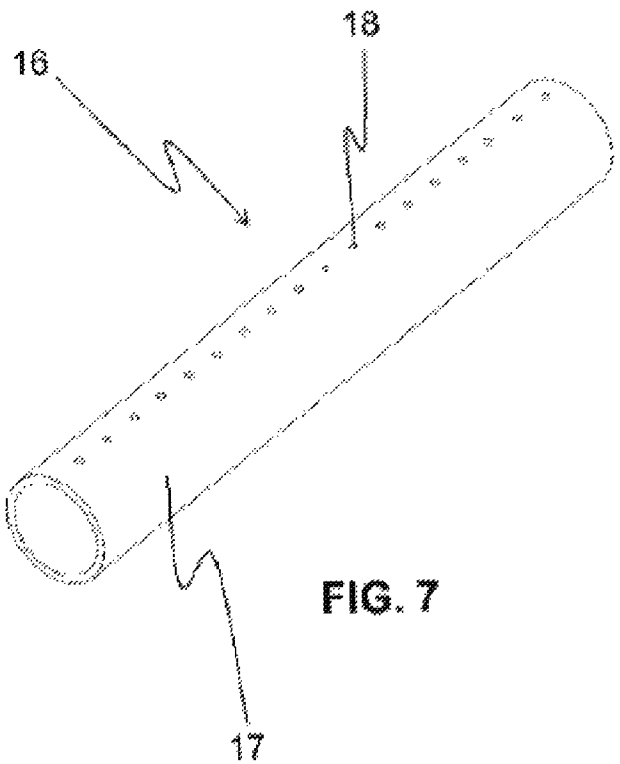
FIG. 7 shows an isometric view of a first embodiment of a selectively perforated hose used in the air supply system for a group of cells of the present invention, with continuous perforations aligned at 0°.
Figure 10:
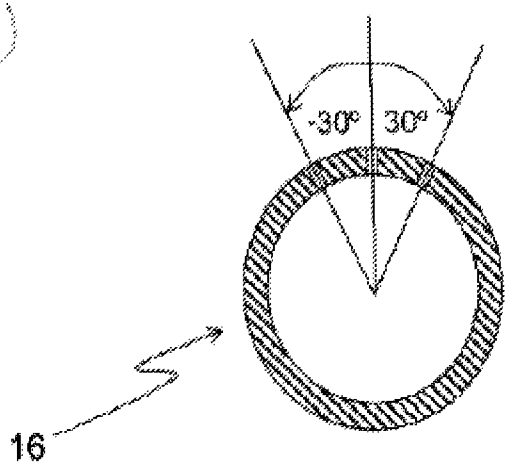
FIG. 10 shows a cross section view of the hoses used in the system of the present invention which has aligned perforations between −90° and +90, preferably between −30° and +30°
Figure 9:
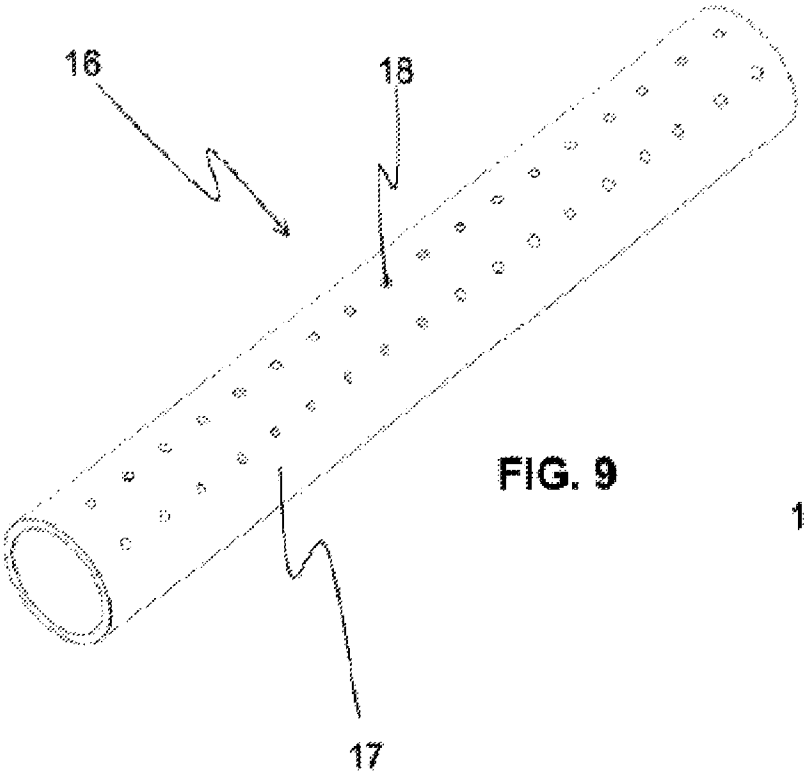
FIG. 9 shows an isometric view of a third embodiment of selectively perforated hose used in the air supply system for a group of cells of the present invention with a pattern of double continuous perforations aligned at 0° and 30°.

In FIGS. 7 to 9, three alternative hose perforation schemes are shown, and in FIG. 10, the angles of perforation are shown in a cross section cut, which are in a range of −30° to +30° but could also be in a range of −90° to +90°, taking the vertical axis of the hose as reference. Selectively perforated hoses (16) are designed to be part of the air supply system of embodiments of the present invention, made from flexible anti corrosive plastic (17) of relatively thick walls, which bear a lineal or not lineal distribution of perforations (18) parallel to the longitudinal axis of hose (16), where said hoses with perforations once placed in the electrolytic cell (2), said perforations in quantities and grouped or not in given patterns remain globally oriented as desired with respect to the electrolyte surface for homogeneous and uniform bubbling. In a first embodiment, perforations (18) are equidistantly separated along the length of the hose and at 0°, and in a second embodiment perforations (18) are grouped in groups of perforations (19) and at 0°, wherein each group of perforations (19) is likewise separated equidistantly. The fact that the holes (19) are selectively perforated, with perforation diameters varying in the range of 0.2 to 0.6 mm, allows a priori to know the permanent pneumatic characteristics of the diffusers selected in order to stably supply the desired air demand of each electrolytic cell (2) and thus obtain in each cell the benefits brought by soft aeration.

Figure 11:
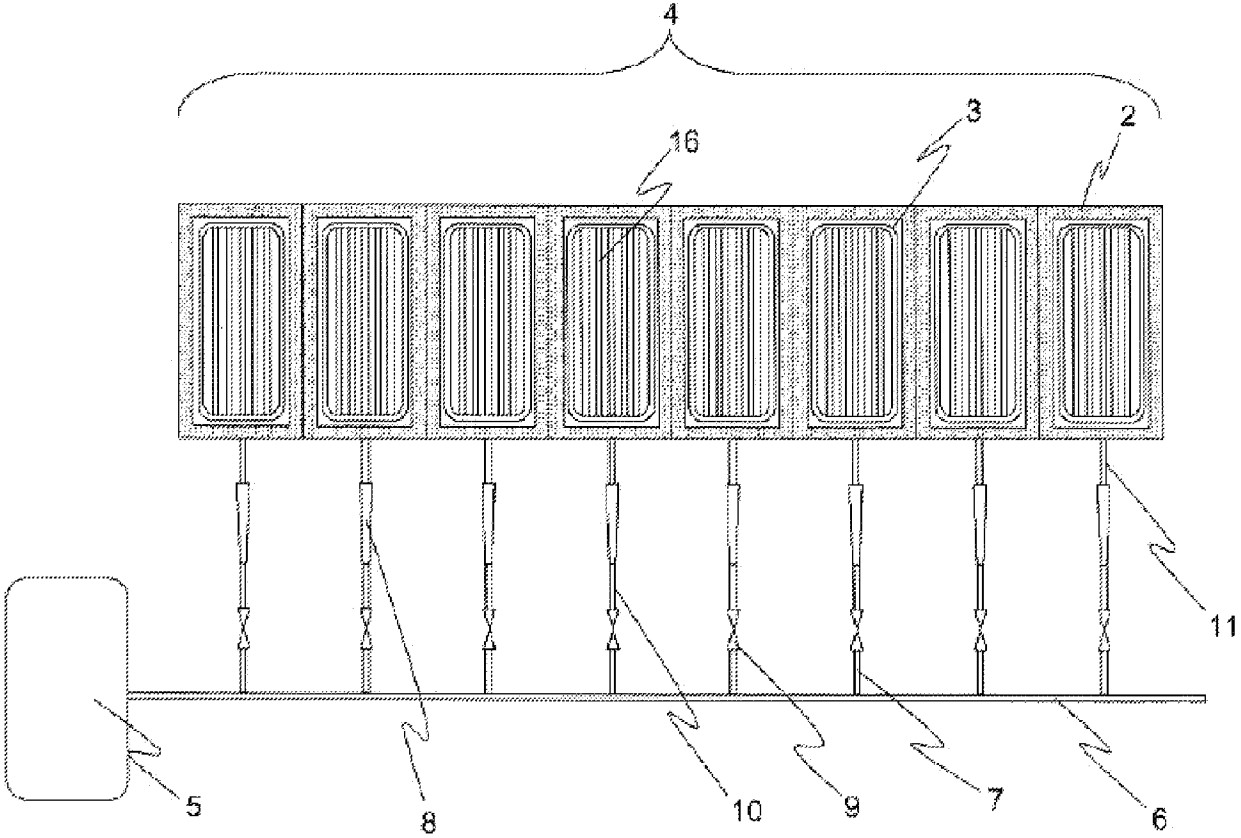
FIG. 11 shows a schematic view of the air supply system for a group of cells shown in FIG. 1.
Figure 12:
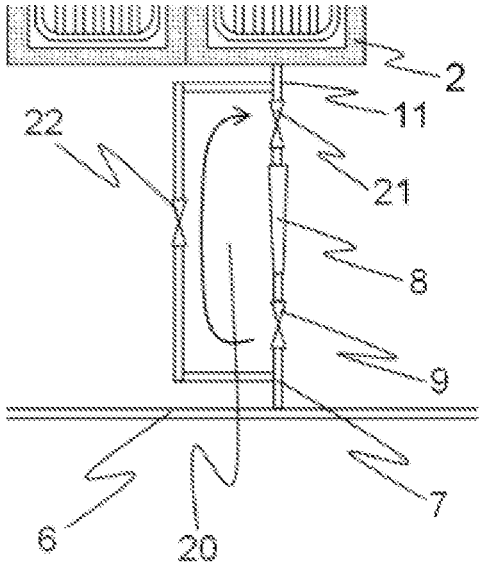
FIG. 12 shows a schematic partial view of a second embodiment of the air supply system for a group of cells.
Figure 13:
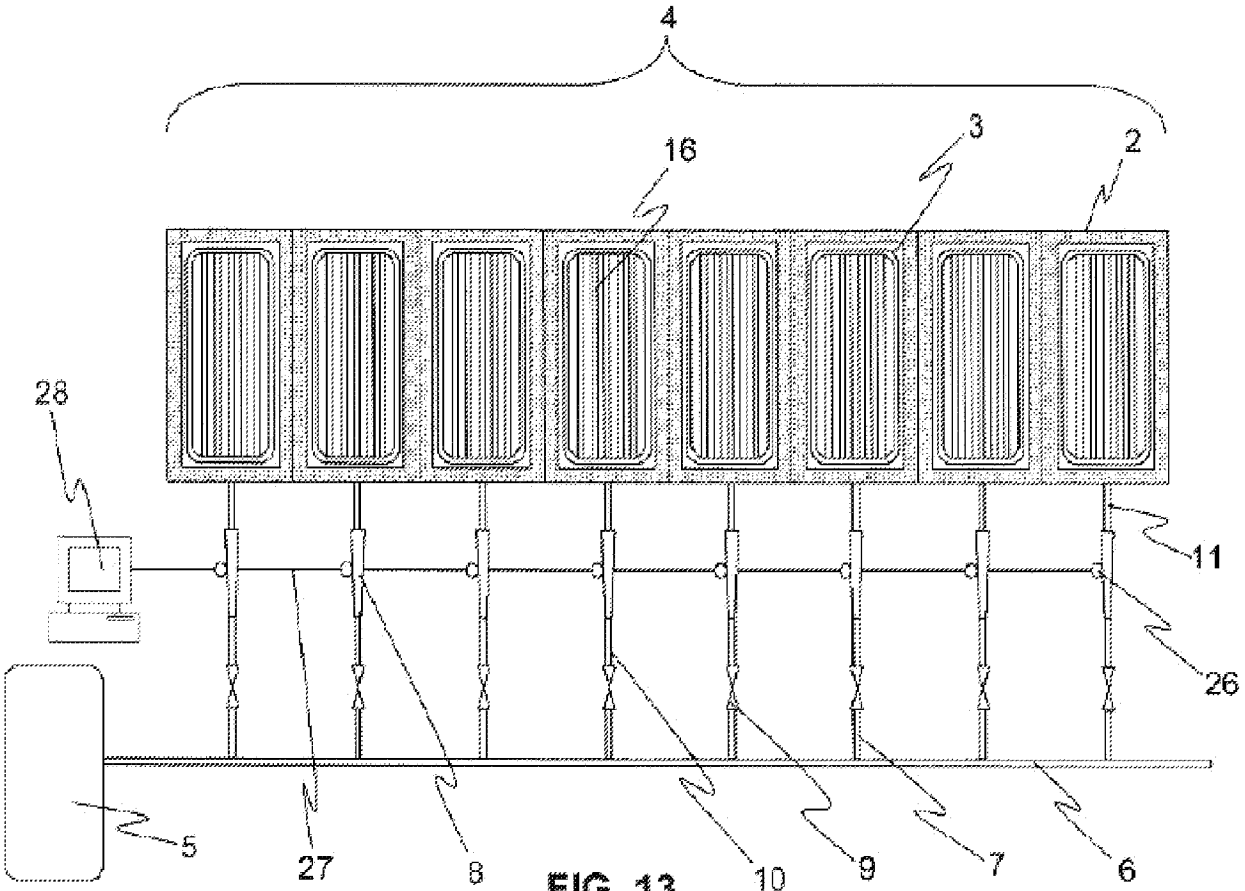
FIG. 13 shows a schematic view of the air supply system for a group of cells shown in FIG. 1, including a monitoring system.

The air supply system operates in the practical terms described, as shown in scheme of FIG. 11. However, it may be important to consider practical events, such as, for example that flow meter (8) goes down or malfunctions, or that problems arise with the air diffusion system inside a cell, or that it becomes necessary to run trials of the effects in electrodeposition in a particular electrolytic cell (2) of the group of cells (4) with other alternative air demands. For such purposes, in between each electrolytic cell (2) and the central air feed pipe (6) a by pass (20). —is installed. The entrance of bypass (20) is connected to the branch hose (7) and the exit is connected to the second feed hose (11) at the exit of flow meter (8). To cancel the effect of flow meter (8), besides flow regulator (9), a second flow regulator (21) is provided so that flow meter (8) is in effect totally disabled. In order for the air flow to continue towards the cell, bypass (20) is supplied with cut off valve (22).

When an air supply system is installed in a cell, it is necessary to go through a start up, operation and monitoring protocol to assure correct operation of the electrodeposition process.

For that purpose, it is necessary to bear in mind that an electrolytic cell has several known operational parameters that must be regulated, harmonized and controlled, among which are: cell voltage, current density, temperature, electrolyte density and pH among others. These parameters determine the quality of the electrodeposited copper obtained during harvest. As has been pointed out, with soft aeration yet another additional parameter to those mentioned is added to the cell operation management protocol, and also needing attention, control and adjustment, such as verification of ongoing homogeneous and controlled gas diffusion, preferably air, from a designated horizontal plane near the bottom of the cell and under the electrodes, to favor or enhance the results of metallic electrodeposition. In practice, all cell parameters are adjusted according to the electrodeposition results being obtained in the cathodes. To the extent that the metal quality deposit in the cathodes is improved, the parameters are maintained fixed during the operation of the cell, and only re adjusted, if and when needed to overcome adverse variations in the quality of cathodes harvested. This variability is going to depend on the degree of wear and tear, service life and replacements in the cell and its accessory elements. This is why it is rather complex to correlate all these parameters in a plant and for each cell, and therefore it is absolutely necessary to constantly monitor process variables in real time, preferably with electronic monitoring sensors that emit alert signals in the event that said parameters drift or go outside their designated predetermined ranges.

For all the facts disclosed above, the air flow that each cell demands is different in time according to the corresponding pneumatic characteristics of its diffuser means, and therefore, it becomes necessary to determine cell by cell the optimal air flow it must receive.

To achieve this, the following steps are proposed that enable operating the air supply system of embodiments of the present invention:

1. Determine the air demand of each cell according to the operational parameters and resulting cathodes harvested.

2. Measure the air flow between the entrance and exit of the flow meter (8) to calibrate it to the air flow determined in step (1)
3. Determine the weight of the sphere (15) to be inserted in the flow meter (8) in such a way that it is maintained floating statically with air flow established in step (1)
4. Introduce the sphere (15) determined in step (3) inside the flow meter (8)
5. Calibrate the flow meter (8) in such a way that the sphere floats statically between a maximum limit (24) and a minimum limit (25).

Once each cell system has been calibrated with the proper air flow, it is possible to monitor the given air flow parameter for correct cell operation. To accomplish this, a sensor (26) can be connected for transmitting signals through a communication media (27) to a monitoring means (28) that track that each sphere (15) in each cell is maintained between the maximum limit (24) and the minimum limit (25). If any sphere (15) goes outside of established limits, an alert signal will be emitted enabling to take corrective actions in the event of some anomalous condition occurring in a cell (2) of the group of cells (4).

The sphere (15) can be visually adjusted between the range of the maximum limit (24) and the minimum limit (25) by means of the translucent tube (14) according to what has been said above. However, if the flow meter (8) is supplied with a system of sensors, this adjustment can be made by electronic means, in which the sensors are located between the maximum limit (24) and the minimum limit (25) sending signals to the monitoring means (28).

The invention claimed is:

1. An air supply system (1) for a group of electrolytic cells (4) arranged for dosing the individual air demand of each electrolytic cell (2) that must be fed to its electrolyte through a system of controlled air diffusion, characterized in that it comprises:

at least one low pressure blower (5);

at least one central feed pipe (6) connected to said at least one blower (5), wherein from said at least one central air feed pipe (6) emerge a plurality of feed hose branches (7), wherein each of said electrolytic cells having walls and each branch of said feed hose branches reaches up to a front wall of said walls;

selectively perforated hoses (16) formed by flexible anticorrosive material hoses (17) which have a selective distribution of perforations (18) parallel to the longitudinal axis of each of said selectively perforated hoses (16);

a flow meter (8) arranged in each of said feed hose branches, the volume of air measured by said flow meter (8) being regulated by a flow regulator (9), and wherein said flow meter (8) is connected between a first feed hose (10) of said branch (7) and a second feed hose (11) of said branch (7), said first hose (10) being connected with flow regulator (9) and said second hose (11) being connected to a portion of bent hose (12) suitable to be affixed on the walls of said electrolytic cell (2) to allow a hose end (13) to be connected with an isobaric ring (3), so that the fed air can be diffused homogeneously and sustainedly in time to the electrolyte through said selectively perforated hoses (16), wherein besides flow regulator (9) a second flow regulator (21) is provided to enable deactivation of flow meter (8); and a bypass (20) provided between each electrolytic cell (2) and the central feed pipe (6), wherein a first end of said bypass (20) is connected to the branch hose (7) and the second end of said bypass is connected to the second feed hose (11), and wherein said bypass (20) is provided with a cut off valve (22).

2. An air supply system (1) for a group of electrolytic cells (4) according to claim 1, characterized in that flow regulator (9) is an adjustable squeeze clamp for the feed hose (7).

3. An air supply system (1) for a group of electrolytic cells (4) according to claim 1, characterized in that the flow regulator (9) is a valve.

4. An air supply system (1) for a group of electrolytic cells (4) according to claim 1, characterized in that said flow meter (8) comprises a translucent tube (14) in whose interior a sphere (15) is lodged, said translucent tube having a maximum limit (24) and a minimum limit (25) wherein sphere (15) statically floats in between according to the given flow of air of air required.

5. An air supply system (1) for a group of electrolytic cells (4) according to claim 4, characterized in that said translucent tube has an inverted conical shape, wherein the lower portion of said tube is supplied with a seat (23) to lodge sphere (15) obstructing the passage of fluids and acting as an emergency retention valve, in the event that the hydraulic column pressure of the electrolyte inside the electrolytic cell (2) is greater than the pressure of the fed air flow, into electrolytic cell (2).

6. An air supply system (1) for a group of electrolytic cells (4) according to claim 5, characterized in that in the lower portion of flow meter (8) a second sphere (30) is lodged and a corresponding occluding seat (29) is provided to allow to block passage to the electrolyte if its backpressure is greater than the pressure of the fed air flow into electrolytic cell (2).

7. An air supply system (1) for a group of cells (4) according to claim 5, characterized in that in the lower portion of flow meter (8) a unidirectional valve is lodged that allows to shut off the passage of electrolyte if its backpressure is greater than the pressure of the fed air flow into electrolytic cell (2).

8. An air supply system (1) for a group of electrolytic cells (4) according to claim 5, characterized in that said flow meter (8) has sensors (26) suitable for emitting alert signals to a monitoring means (28) enabling timely actions to be taken in the event of detection of anomalies or faults of air supply system (1) in any electrolytic cell (2).

9. An air supply system (1) for a group of electrolytic cells (4) according to claim 1, characterized in that the perforations are equidistantly separated along the length of the hose.

10. An air supply system (1) for a group of electrolytic cells (4) according to claim 9, characterized in that the angles of the perforations, seen in transversal cut, are within a range of −90° to +90°.

11. An air supply system (1) for a group of electrolytic cells (4) according to claim 10, characterized in that said range is preferably of −30° to +30°.

12. An air supply system (1) for a group of electrolytic cells (4) according to claim 9, characterized in that said perforations have a diameter ranging between 0.2 to 0.6 mm.

13. An air supply system (1) for a group of cells (4) according to claim 1, characterized in that the perforations are arranged in groups, the groups of perforations being separated equidistantly.

* * * * *